US005666895A

United States Patent [19]

Gehres et al.

[11] Patent Number: 5,666,895

[45] Date of Patent: Sep. 16, 1997

[54] ADJUSTABLE CLAMP

[75] Inventors: Clint Edwin Gehres, Moraine; Anthony David Vigh, West Carrollton; Kirk William Neer, Urbana, all of Ohio

[73] Assignee: MIM Industries, Inc., Miamisburg, Ohio

[21] Appl. No.: 376,054

[22] Filed: Jan. 20, 1995

Related U.S. Application Data

[63] Continuation of Ser. No. 944,880, Sep. 14, 1992, abandoned, which is a continuation-in-part of Ser. No. 718,012, Jun. 20, 1991, Pat. No. 5,146,859.

[51] Int. Cl.[6] ..... D05B 3/20; D05B 21/00

[52] U.S. Cl. ..... 112/114; 112/470.07; 112/470.14; 112/475.05

[58] Field of Search ..... 112/121.12, 121.15, 112/114, 103, 104, 115, 119, 262.1, 262.3, 265.1, 70, 76, 235, 311, 320, 153, 470.06, 470.07, 470.09, 470.14, 102.5, 475.04, 475.05, 475.19; 269/87.1, 87.2, 87.3, 91

[56] References Cited

U.S. PATENT DOCUMENTS

| | | | |
|---|---|---|---|
| 278,485 | 5/1883 | Arnold . | |
| 1,222,618 | 4/1917 | Gammons . | |
| 1,387,034 | 8/1921 | Barron et al. . | |
| 1,569,231 | 1/1926 | Mayo . | |
| 2,223,626 | 12/1940 | Ladue | 112/2 |
| 2,630,087 | 3/1953 | Liero et al. | 112/114 |
| 2,726,613 | 12/1955 | Eddy | 112/114 |
| 2,768,592 | 10/1956 | Bihaly | 112/121.15 |
| 3,098,460 | 7/1963 | Yoshida | 112/235 |
| 3,104,637 | 9/1963 | Hedegaard | 112/104 |
| 3,216,383 | 11/1965 | Bono | 112/470.06 X |
| 3,664,283 | 5/1972 | McFalls | 112/121.15 |
| 3,664,288 | 5/1972 | Boden et al. | 112/103 |
| 3,703,873 | 11/1972 | Kalish | 112/153 |
| 3,739,733 | 6/1973 | Schramayr | 112/121.12 |
| 3,799,086 | 3/1974 | Block | 112/121.15 |
| 3,830,175 | 8/1974 | Levor | 112/121.12 |
| 3,875,877 | 4/1975 | Fox | 112/63 |
| 3,875,878 | 4/1975 | Kaminski | 112/116 |
| 3,970,016 | 7/1976 | Yanikoski | 112/121.12 |
| 4,171,672 | 10/1979 | Dorosz et al. | 112/121.12 |
| 4,273,059 | 6/1981 | Kamal | 112/121.14 |
| 4,296,699 | 10/1981 | Vartoukian | 112/121.15 |
| 4,305,338 | 12/1981 | Adamson | 112/113 |
| 4,455,952 | 6/1984 | Morin et al. | 112/121.12 |
| 4,462,320 | 7/1984 | Scholl | 112/104 |
| 4,479,447 | 10/1984 | Rohr | 112/141 |
| 4,493,276 | 1/1985 | Sadeh | 112/121.12 |
| 4,494,470 | 1/1985 | Fischer et al. | 112/121.15 X |
| 4,498,407 | 2/1985 | Landwehr et al. | 112/308 |

(List continued on next page.)

FOREIGN PATENT DOCUMENTS

| | | | |
|---|---|---|---|
| 1715908 | 2/1992 | U.S.S.R. | 112/114 |
| 2115026 | 9/1983 | United Kingdom | 112/311 |

OTHER PUBLICATIONS

"The Technologies of MIM Industries, Inc." sales brochure, pub. approx. Jan. 1, 1990.

*Primary Examiner*—Peter Nerbun
*Attorney, Agent, or Firm*—Jacox, Mackstroth & Jenkins

[57] ABSTRACT

An adjustable clamp for use in a sewing machine is disclosed. The adjustable clamp comprises a template clamp which is slidably and adjustably fastened to a plurality of pins extending from a clamp support. The clamp support and template clamp have a first template and a second template, respectively. The adjustable clamp permits the distance between the first and second templates to be slidably adjusted to a predetermined distance, for example, in order to accommodate a change in the distance between a first predetermined stitch pattern and a second predetermined stitch pattern. In another embodiment, the clamp comprises spacer clamps which may be mounted onto the pins to provide a third template. The spacer clamps may also be provided in predetermined shapes so that, when they are mounted between the clamp support and template clamp, they cooperate to define a fourth template.

35 Claims, 11 Drawing Sheets

U.S. PATENT DOCUMENTS

| | | | |
|---|---|---|---|
| 4,503,788 | 3/1985 | Giannuzzi et al. | 112/121.12 |
| 4,534,303 | 8/1985 | Off et al. | 112/114 |
| 4,603,647 | 8/1986 | Conley, Jr. et al. | 112/129 |
| 4,610,210 | 9/1986 | Kinoshita et al. | 112/121.12 |
| 4,622,907 | 11/1986 | Kimura | 112/121.12 |
| 4,639,964 | 2/1987 | Binder | 112/142 |
| 4,664,045 | 5/1987 | Landwehr et al. | 112/153 |
| 4,682,551 | 7/1987 | Toman | 112/103 |
| 4,696,242 | 9/1987 | Scholl et al. | 112/121.14 |
| 4,708,072 | 11/1987 | Frye | 112/121.27 |
| 4,763,587 | 8/1988 | Frye | 112/121.12 |
| 4,799,438 | 1/1989 | Hinckle | 112/121.12 |
| 4,854,251 | 8/1989 | Hiramatsu et al. | 112/121.12 |
| 4,870,917 | 10/1989 | Frye | 112/121.12 |
| 4,883,006 | 11/1989 | Marii et al. | 112/121.12 |
| 4,903,620 | 2/1990 | Bisson et al. | 112/121.15 X |
| 4,920,904 | 5/1990 | Frye | 112/262.1 |
| 4,989,525 | 2/1991 | Portilla | 112/10 |
| 5,005,501 | 4/1991 | Kita | 112/121.12 |
| 5,014,633 | 5/1991 | Murata et al. | 112/121.12 |
| 5,052,316 | 10/1991 | Sakakibara | 112/121.15 |
| 5,094,179 | 3/1992 | Badillo | 112/114 |

FIG. 1
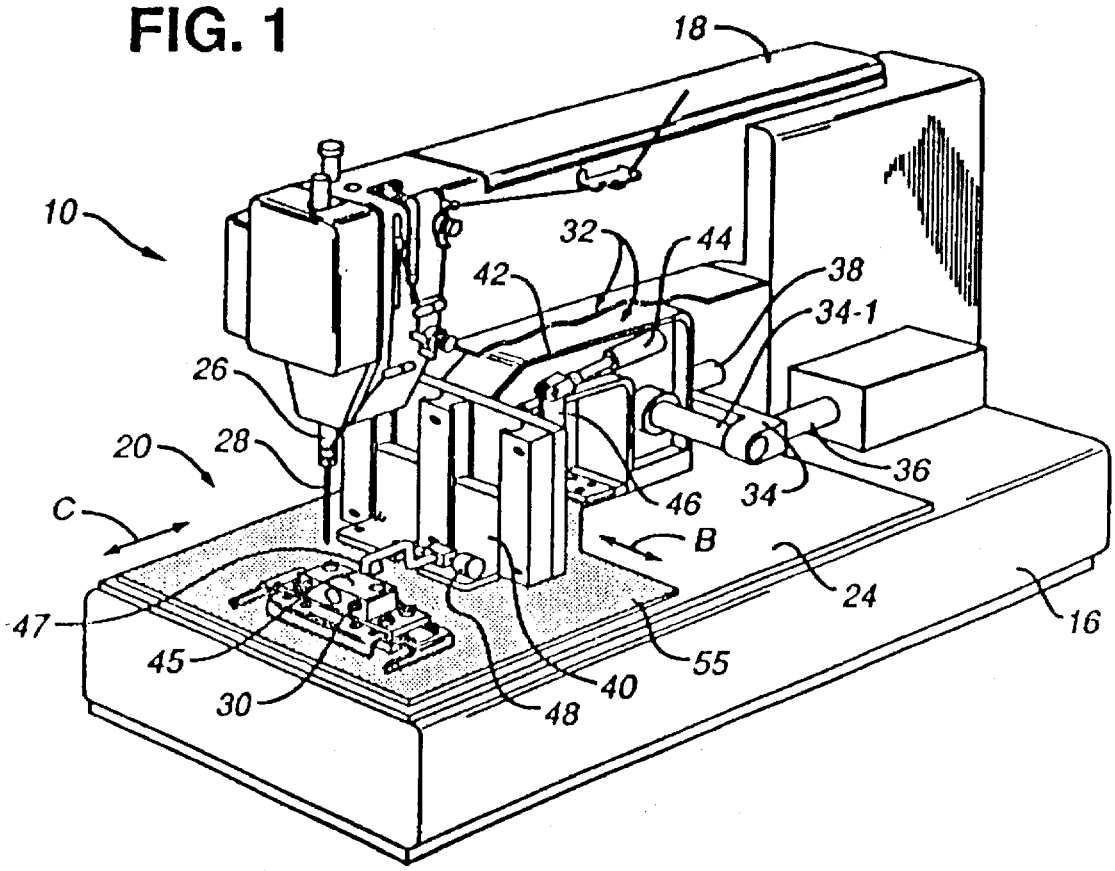
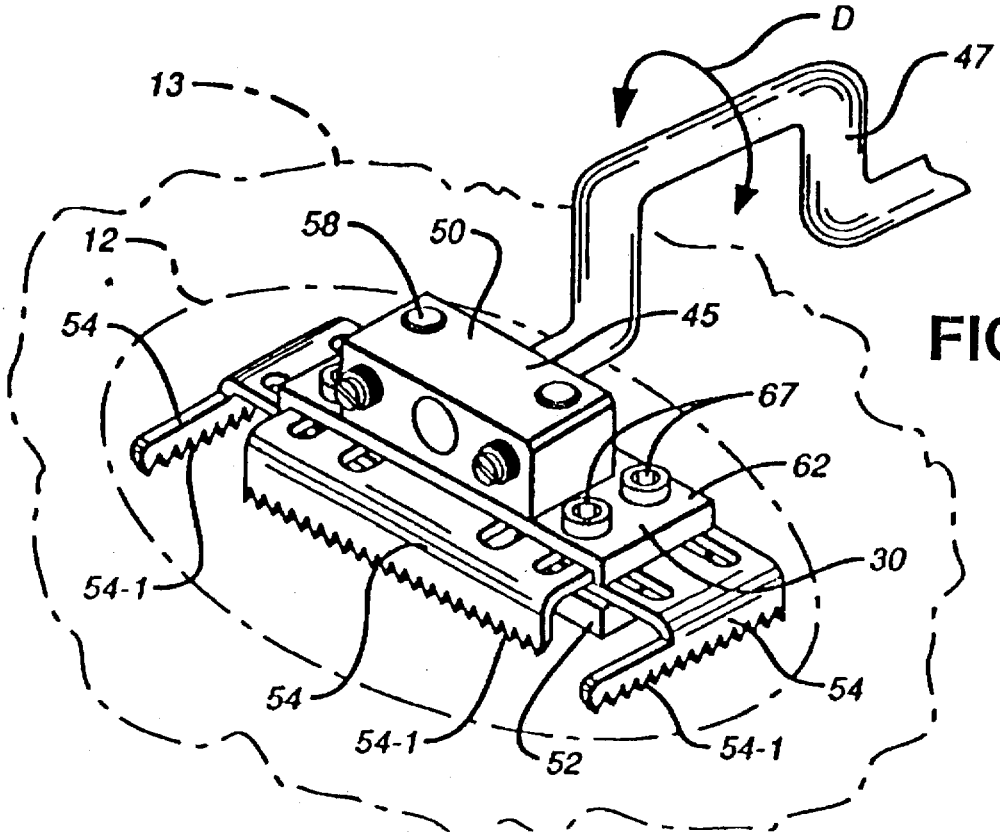
FIG. 2

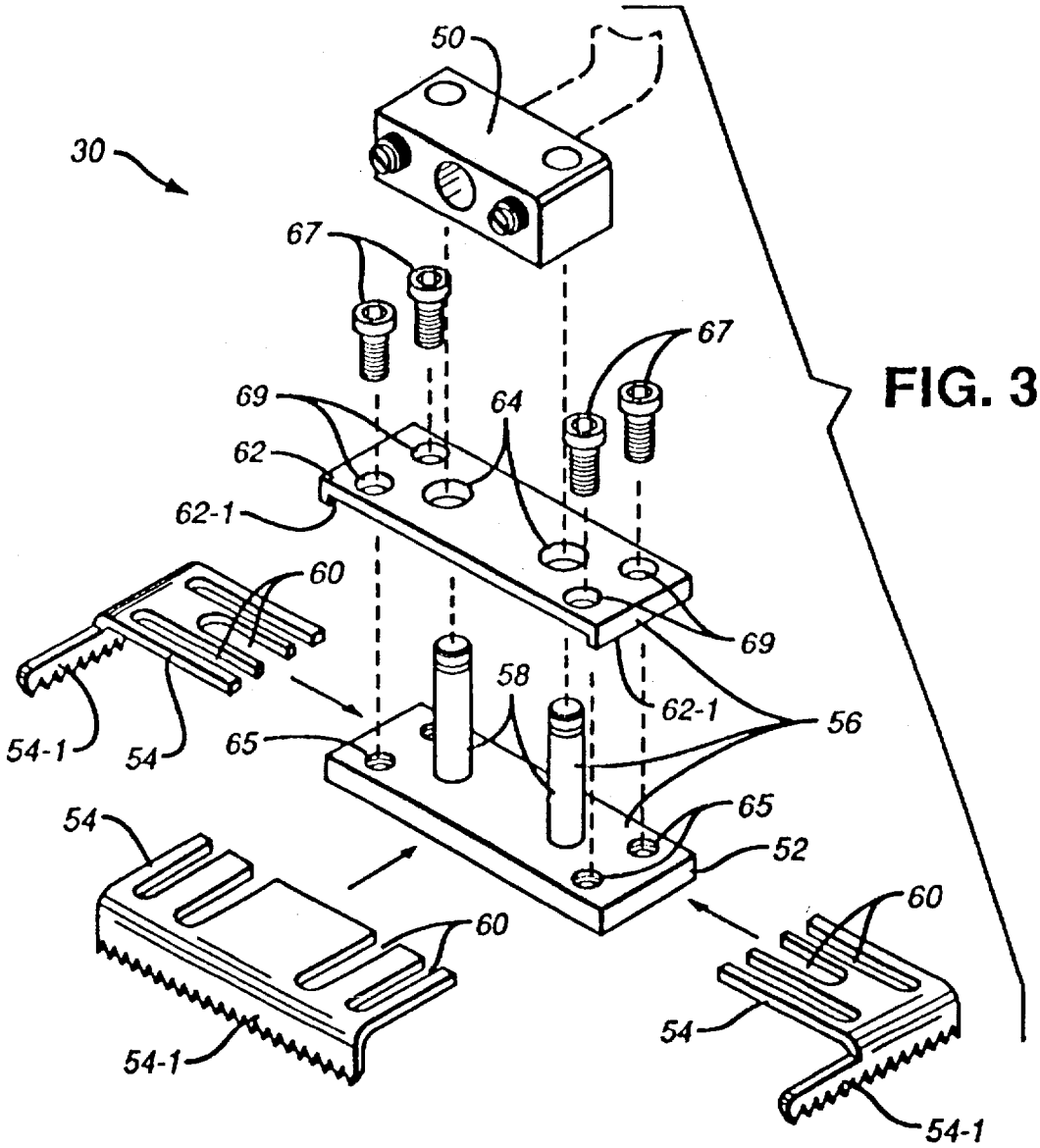
FIG. 3
FIG. 4
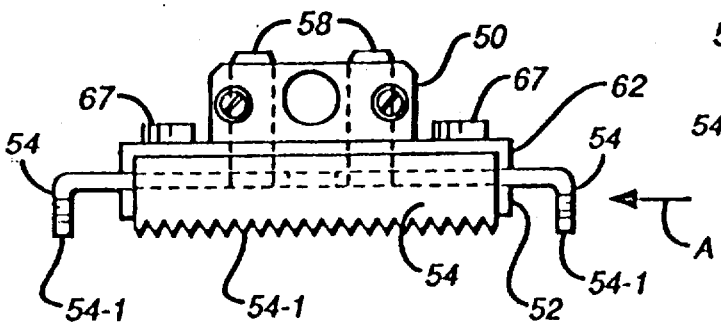
FIG. 5
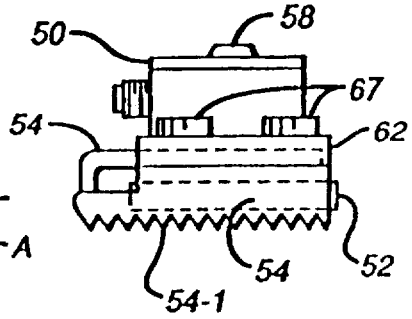

ADJUSTABLE CLAMP

CROSS-REFERENCE TO RELATED APPLICATION

This is a continuation of application Ser. No. 07/944,880, filed Sep. 14, 1992, now abandoned, which is a continuation-in-part application of Ser. No. 07/718,012, now U.S. Pat. No. 5,146,859, issuing Sep. 15, 1992, and assigned to the assignee of the present invention.

BACKGROUND OF THE INVENTION

1. Field of the Invention

This invention relates to a clamp, and more particularly, it relates to an adjustable clamp having a plurality of adjustable clamp templates and also having clamp and template areas which are adjustable.

2. Description of Related Art

In the sewing industry, a common repetitive function is to sew a label onto a workpiece of material. For example, this would be a common procedure when sewing a manufacturer's label onto a workpiece, such as a shirt or jacket. A clamp was typically used to force the central portion of the label against the workpiece and also against the sewing surface of the sewing machine. The sewing machine then moved the workpiece and label under an oscillating needle in order to sew the label onto the workpiece with a predetermined stitch pattern. The clamp was also used to secure either the label or the workpiece against the sewing surface so that the predetermined stitch pattern could be sewn thereon. The clamps of the prior art had a defined clamping surface which could not be adjusted to accommodate labels of different shapes or to accommodate different predetermined stitch patterns. Accordingly, a user was required to maintain an inventory of clamps for each workpiece shape and for each predetermined stitch pattern. Maintaining such an inventory of clamps was expensive.

It was also not uncommon that a workpiece had to be sewn with two separate stitch patterns. This was often done by providing a clamp having two fixed template or cut-out areas which corresponded to the two separate stitch patterns. If it was desired to change, for example, the distance between the two cut-out areas, then a different clamp had to be used. Also, if it was desired to add a sewing template or to adjust the shape of the sewing template, this could not be done easily. This also resulted in the user having to maintain an inventory of clamps.

Still another problem is that the programmable sewing machine had to be shut down whenever the adjustable clamp had to be changed due to a change in either the predetermined stitch pattern or the workpiece shape. This downtime resulted in lost production and labor time.

SUMMARY OF THE INVENTION

There is, therefore, a present need to provide an adjustable clamp having a plurality of adjustable clamp members which permit the clamp to be adjustable to a predetermined clamp size.

In one aspect, this invention includes an adjustable clamp, comprising a clamp support; and a template clamp for adjustably mounting onto said clamp support.

An object of this invention is to provide an adjustable clamp which can be adjusted in order to clamp labels of different shapes against a workpiece.

Another object of this invention is to provide an adjustable clamp which can be adjusted in order to accommodate a change in a predetermined stitch pattern being sewn on a label or workpiece.

Another object of this invention is to provide an adjustable clamp which reduces or eliminates the need for maintaining an inventory of clamps.

Another object is to provide an adjustable clamp having a clamp area which is adjustable.

Still another objection of this invention is to provide an adjustable clamp wherein the clamping area can be easily adjusted to a predetermined clamping area.

Still another object is to provide an adjustable clamp wherein it is easy to add one or more templates.

Another object of this invention is to provide a clamp having a plurality of clamp templates which are adjustable.

Yet another object of this invention is to provide a method which permits an operator to quickly and easily adjust either the clamping area or template area of an adjustable clamp.

These objects, and others, may be more readily understood in connection with the following specification, claims, and drawing.

BRIEF DESCRIPTION OF THE DRAWING

FIG. 1 is a perspective view of a programmable sewing machine in which a preferred embodiment of this invention may be used;

FIG. 2 is a perspective view of an adjustable clamp coupled to a crank by mounting means;

FIG. 3 is a perspective exploded view of the adjustable clamp shown in FIG. 2;

FIG. 4 is an assembled front of the adjustable clamp;

FIG. 5 is an assembled side view of the adjustable clamp, taken in the direction of arrow A in FIG. 1;

DESCRIPTION OF THE PREFERRED EMBODIMENT

Figure 6:
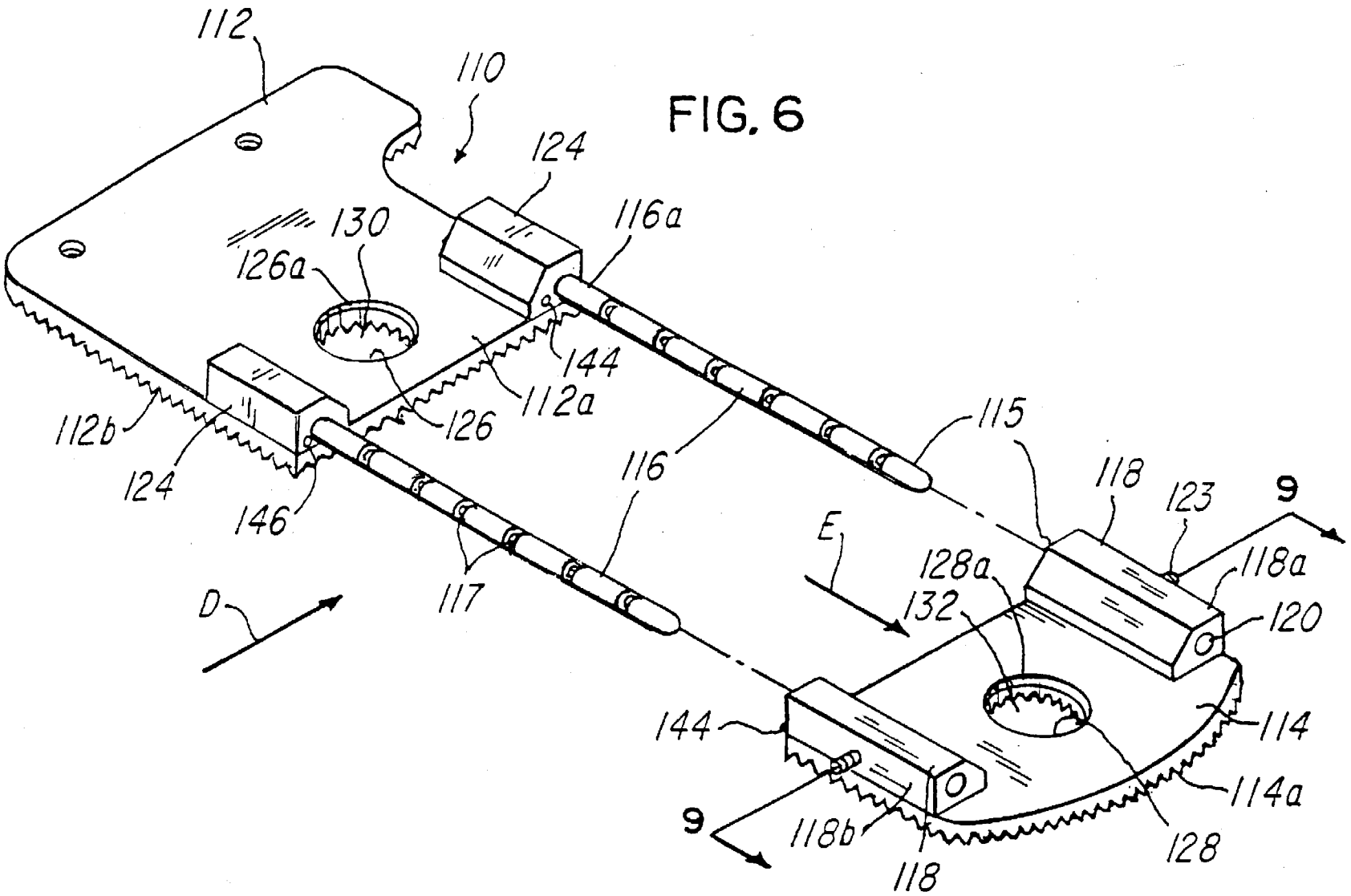
FIG. 6 is a perspective view showing a clamp support having a plurality of parallel pins and a template clamp.

FIG. 1 shows a perspective view of a programmable sewing machine, hereinafter designated as sewing machine 10, in which a preferred embodiment of this invention may be used. The function of the sewing machine 10 is to sew a workpiece 12 (shown in phantom in FIG. 2), such as a label or shirt pocket, onto a second workpiece 13, like a jacket or shirt. In a preferred embodiment, the workpiece 12 is sewn onto the second workpiece 13 with a predetermined stitch pattern (not shown) in accordance with a computer program (not shown) which is controlled by a master controller (not shown) in the sewing machine 10. The sewing machine 10 may be any programmable sewing machine, including any of the Brother BAS Series 300 programmable sewing machines, such as the BAS Model 340, which are manufactured by Brother Industries of Japan. The sewing machine 10 comprises a base 16 having a horizontal arm 18 secured thereto. The sewing machine 10 also comprises a sewing station 20 at which the workpiece 12 can be sewn onto the second workpiece 13 with the predetermined stitch pattern. The sewing station 20 (FIG. 1) includes a sewing surface 24. As best illustrated in FIG. 1, the horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread (not shown) to a looptaker (not shown) under the sewing surface 24 at the sewing station 20. The looptaker and needle 28 are both connected to a motor (not shown) which is controlled by the master controller (not shown) in the sewing machine 10.

The sewing machine 10 further includes an adjustable clamp 30 which is coupled to drive means 32. The function of drive means 32 is to move the adjustable clamp 30 at the sewing station 20 in accordance with the computer program (not shown) so that the workpiece 12 can be sewn on the second workpiece 13. The drive means 32 comprises a yoke shaft 34-1 of a yoke 34 which permits the adjustable clamp 30 to move in an X direction, indicated by double arrow B in FIG. 1. The yoke 34 is coupled to a pair of shafts 36 and 38 which can cause the yoke 34 and adjustable clamp 30 to move in a Y direction, indicated by double arrow C in FIG. 1. The shafts 36 and 38 are coupled to a stepper motor (not shown) by various belts, gears and pulleys (not shown) in the sewing machine 10. As best illustrated in FIG. 1, the adjustable clamp 30 is coupled to an L-shaped bracket 40 which is slidably mounted to a support arm 42. The drive means 32 also comprises a solenoid 44 which is coupled to L-shaped bracket 40 by armature 46. The support arm 42 is coupled to a second stepper motor (not shown) under sewing surface 24. Although not shown, the drive means 32 could include a different configuration of drive mechanisms, such as solenoids (not shown), gears (not shown) and pulleys (not shown), or it could include any other suitable means for moving the adjustable clamp 30 in the X or Y directions. The master controller (not shown) can energize the stepper motor and the second stepper motor individually or simultaneously to move the adjustable clamp 30 in the X or Y directions, thereby permitting the sewing machine 10 to move the adjustable clamp 30 in accordance with the computer program so that the workpiece 12 can be sewn on the second workpiece 13 with the predetermined stitch pattern. In addition, the master controller can also energize the solenoid 44 to cause the L-shaped bracket 40 and the adjustable clamp 30 to move towards and away from the sewing surface 24.

The sewing machine 10 also comprises means for permitting the sewing machine 10 to sew around the support 52 and clamp members 54. The means may comprise any suitable means for permitting the sewing machine to sew around the support 52, but in the embodiment being described, means comprises mounting means 45 (FIG. 1) for detachably mounting the adjustable clamp 30 to the L-shaped bracket 40. The mounting means 45 comprises a 360° crank 47 which is coupled to a solenoid 48 which in turn is coupled to the master controller (not shown). The master controller can selectively energize the solenoid 48 to cause the crank 46 to flip-flop in the direction of double arrow D in FIG. 2 so that the sewing machine can sew a 360 stitch pattern. The mounting means 45 further comprises a quick-release mechanism 50 which enables the adjustable clamp 30 to be quickly and easily dismounted from the sewing machine 10. The quick release mechanism 50 is similar to the release mechanisms shown and described in U.S. Pat. No. 4,763,587, issued on Aug. 16, 1988, and U.S. Pat. No. 4,870,917, issued on Oct. 3, 1989, which are assigned to the same assignee as the present application and which are hereby incorporated by reference and made a part hereof. Although not shown, the mounting means 45 could include a different means for mounting the adjustable clamp 30 to the sewing machine 10, such as machine screws, bolts, welding or any other suitable means for securing the adjustable clamp 30 to the sewing machine 10.

As best shown in FIGS. 2–5, the sewing machine 10 comprises the adjustable clamp 30 which forces the workpiece 12 against the second workpiece 13 until the workpiece 12 and second workpiece 13 are secured firmly against a cloth plate 55 (FIG. 1). The adjustable clamp 30 comprises the support 52 which is generally planar as best shown in FIG. 3. The adjustable clamp 30 also comprises a plurality of clamp members 54 which are each generally L-shaped, as best shown in FIG. 3. Each of the clamp members 54 has a saw-toothed edge 54-1 which define a predetermined clamping size or pattern. The saw-toothed edges 54-1 facilitate preventing the workpiece 12 and second workpiece 13 from slipping or moving when they are being secured against the cloth plate 55.

The adjustable clamp 30 also includes adjusting means for adjustably securing at least one of said plurality of clamp members 54 to the support 52. In the embodiment being described, adjusting means comprises a fastener 56 for adjustable fastening the plurality of clamp members 54 to the support 52. In a preferred embodiment the fastener 56 includes a pair of posts 58 which upstand from the support 52, as shown in FIG. 3. The fastener 56 also includes a cooperating member 62 having a plurality of apertures 64 for receiving the posts 58. The cooperating member 62 has a depending flange 62-1 on each end thereof which engage the clamp members 54. The cooperating member 62 also comprises apertures 69 for receiving a plurality of screws 67, such as conventional machine screws. The screws 67 are threaded in the threaded holes 65 to secure the cooperating member 62 to the support 52 as shown. Although an embodiment of the adjusting means and fastener 56 has been shown and described herein, it should be appreciated that adjusting means and the fastener 56 could comprise any suitable means for adjustably securing at least one of said plurality of clamp members 54 to the support 52.

As best illustrated in FIGS. 4 and 5, the cooperating member 62 cooperates with the support 52 to secure the plurality of clamp members 54 between the cooperating member 62 and the support 52. Each of the clamp members 54 have slots or grooves 60 which permit the clamp members 54 to be slidably adjusted on the support 52. This feature enables the clamp members 54 to be adjusted so that the adjustable clamp 30 has many different predetermined clamping sizes or patterns. The clamp members 54 can be adjusted in order to provide a larger or smaller clamping pattern if desired. Although the embodiment herein has been shown with a clamping pattern which is generally rectangular, the clamp members 54 could be changed to, for example, clamp members 54 having a circular saw-toothed edge 54-1 which would facilitate providing a circular clamping pattern if desired.

In operation, the apertures 64 (FIG. 3) on the cooperating member 62 are guided onto the posts 58 of the support 52, and the screws 67 are used to secure the cooperating member 62 to the support 52. The grooves 60 of the clamp members 54 are then guided onto the posts 58 and screws 67. The clamp members 54 are adjusted to the predetermined clamp size or pattern which generally corresponds to the shape of the second workpiece 13. After the clamp members 54 have been adjusted to a predetermined clamp size, the screws 67 can then be tightened until the clamp members 54 become secured between the support 52 and the cooperating member 62. The adjustable clamp 30 can then be detachably mounted onto the sewing machine 10 by inserting the posts 58 into the quick-release mechanism 50 (FIG. 1) mentioned earlier herein. Although not shown, the clamp members 54 of the adjustable clamp 30 could be adjusted while the support 52 and cooperating member 62 are mounted to the sewing machine 10. This can be done by loosening the screws 67, adjusting the clamp members 54, and then tightening the screws 67, thereby providing a new predetermined clamp size or pattern.

After the adjustable clamp 30 has been adjusted to the appropriate predetermined clamp size and mounted to the sewing machine 10, the second workpiece 13 can be positioned on the cloth plate 55. The workpiece 12 can then be positioned on the second workpiece 13. The master controller (not shown) can then energize drive means 32 to cause the adjustable clamp 30 to clamp the workpiece 12 against the second workpiece 13 so that the workpiece 12 can be sewn onto the second workpiece 13 with the predetermined stitch pattern. In addition, the adjustable clamp 30 could be used to secure either the workpiece 12 or the second workpiece 13 against the cloth plate 55 so that the sewing machine 10 can sew the predetermined stitch pattern thereon. This may be beneficial, for example, when sewing an ornamental pattern (not shown) on a label (not shown).

Figure 7:
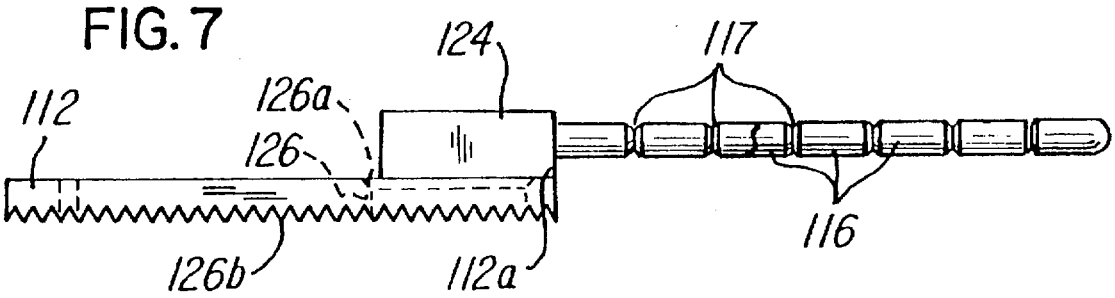
FIG. 7 is a side view, taken in the direction of arrow D in FIG. 6, showing a plurality of pins having a plurality of grooves.
Figure 8:
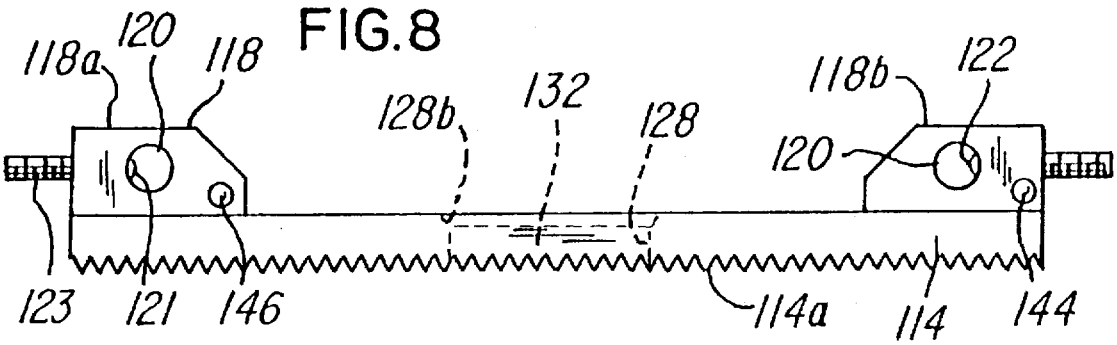
FIG. 8 is a view, taken in the direction of arrow E in FIG. 6, showing details of the template clamp.
Figure 9:
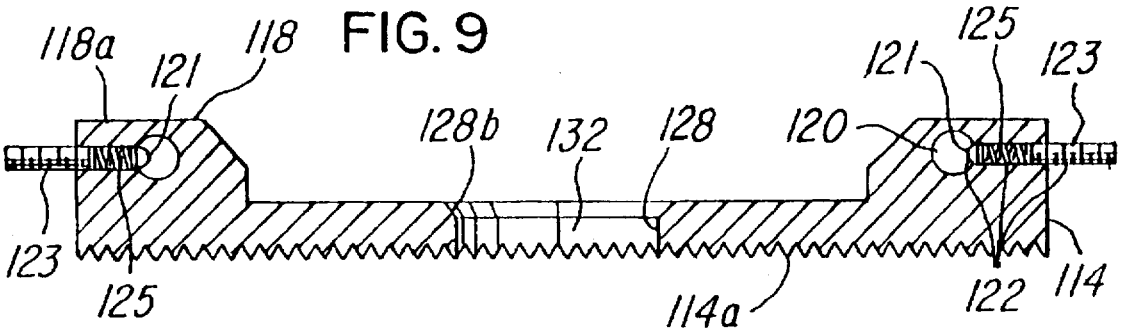
FIG. 9 is a sectional view, taken along the line 9—9 in FIG. 6, showing details of the spring loaded detents used to adjustably secure the template clamp to the pins.

FIGS. 6–20 show another embodiment of the invention. As best shown in FIG. 6, an adjustable clamp 110 is shown having a clamp support 112 and a template clamp 114 for adjustably mounting on the clamp support 112. The adjustable clamp 110 comprises adjustable support means 115 for adjustably supporting the template clamp 114 on the clamp support 112. In the embodiment being described, the adjustable support means 115 comprises a plurality of pins 116 and a plurality of detents 118. The clamp support 112 also comprises a pair of pin supports 124 which have thread apertures (not shown) for receiving a threaded end (not shown) of one of the plurality of pins 116. In the embodiment being described, the pins 116 are generally parallel, elongated and cylindrical and comprise a plurality of V-shaped grooves 117 (FIG. 7). Although the plurality of pins 116 have been described and shown as being cylindrical, they could be any shape which is suitable for permitting the template clamp 114 to be slidably and adjustably mounted to the clamp support 112. In addition, the pins 116 have been described and shown as having the plurality of V-shaped grooves 117, but they could be any suitable shape which is capable of cooperating with the detent 118 to adjustably secure the template clamp 114 to the clamp support 112 (see FIGS. 8 and 9).

Figure 10:
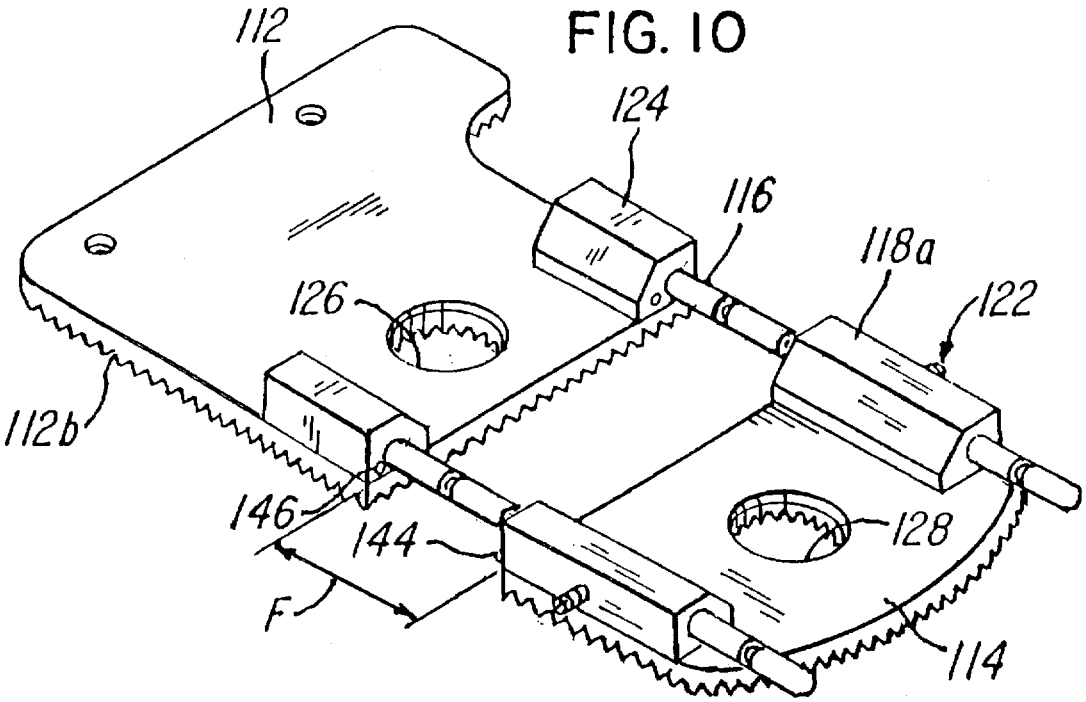
FIG. 10 is a perspective view showing the template clamp adjustably mounted on the pins in an open position.
Figure 11:
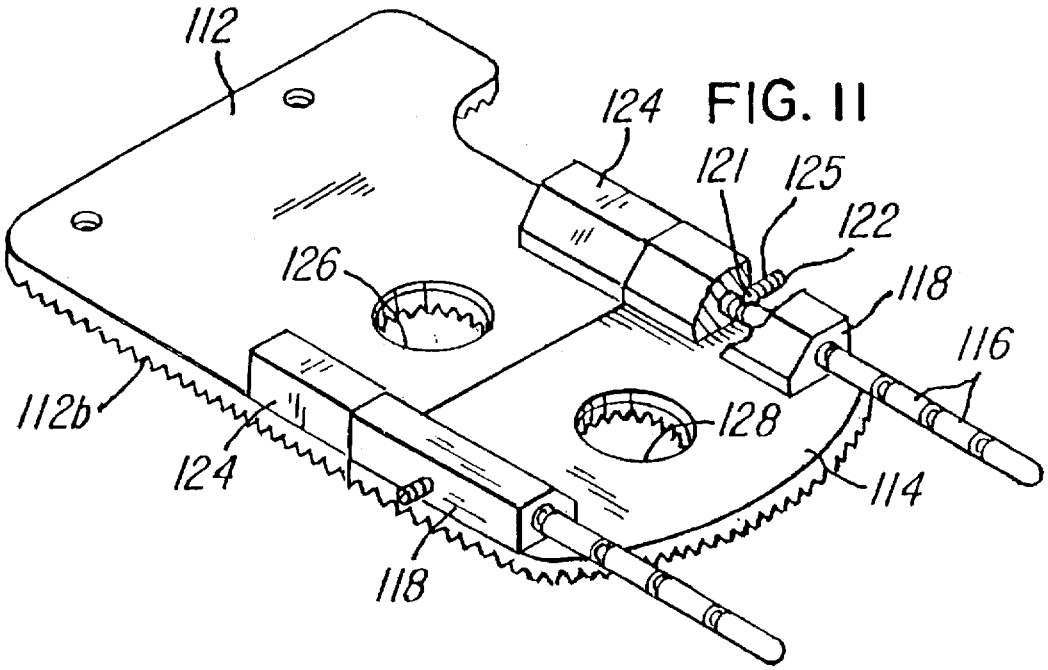
FIG. 11 is another perspective view, similar to that of FIG. 10, showing the template clamp adjusted to a closed position.

The template clamp 114 comprises a plurality of detents 118 or detent means for cooperating with said pins 116 in order to adjustably retain the template clamp 114 on clamp support 112. In the embodiment being described, each of the plurality of detents 118 comprises a sleeve defining an aperture 120 for receiving one of the pins 116. Each detent 118 also comprises at least one spring loaded bearing or ball detent 122 (FIGS. 8, 9 and 11) associated with aperture 120. As best shown in FIGS. 6, 8, 9 and 11, each ball detent 122 comprises a ball 121, screw 123 and spring 125. The screw 123 cooperates with a spring 125 to resiliently bias the ball 121 towards aperture 120. As best shown in FIG. 11, the ball detents 122 cooperate with one of the grooves 117 in pin 116 to adjustably retain template clamp 114 onto clamp support 112. As best shown in FIGS. 10 and 11, the plurality of pins 116 and detents 118 permit the template clamp 114 to be slidably adjusted from an open position shown in FIG. 10 to the closed position shown in FIG. 11.

In the embodiment being described, the detent 118 comprises a spring loaded ball detent; however, it could comprise any suitable means for engaging the pins 116 such that the template clamp 114 can be adjustably and slidably retained on the clamp support 112. For example, the detent 118 could comprise a thumbscrew, fastener, screw, latch or any other suitable detent. It is also to be noted that, although the embodiment being described is shown with each aperture 120 having a detent 118 associated therewith, each aperture 120 could have a plurality of detents 118 associated therewith. Alternatively, it would also be possible to provide a single ball detent 122, for example, on detent **118*a*, and provide detent 118*b* with only an aperture 120 and no ball detent 122**.

As best shown in FIG. 6, the clamp support 112 and template clamp 114 comprise a first template 126 and a second template 128, respectively. In the embodiment being described, the first and second templates 126 and 128 correspond to a first predetermined stitch pattern (not shown) and a second predetermined stitch pattern (not shown), respectively. It is to be noted that the first and second templates 126 and 128 are shown in FIG. 6 as being generally circular, but they could be any suitable shape or pattern. The first template 126 has a bevelled surface **126*a* and the second template 128 has a bevelled surface 128*a* (FIG. 1). The first and second bevelled surfaces 126*a* and 128*a* facilitate guiding the sewing needle 28 into the sewing areas 130 and 132, respectively, defined by the first and second templates 126 and 128. Although not shown, the first and second templates 126 and 128 may be configured with adjoining open template areas such that they cooperate to provide one contiguous template or sewing area (not shown) when the template clamp 114 is moved into the closed position shown in FIG. 11**.

Figure 12:
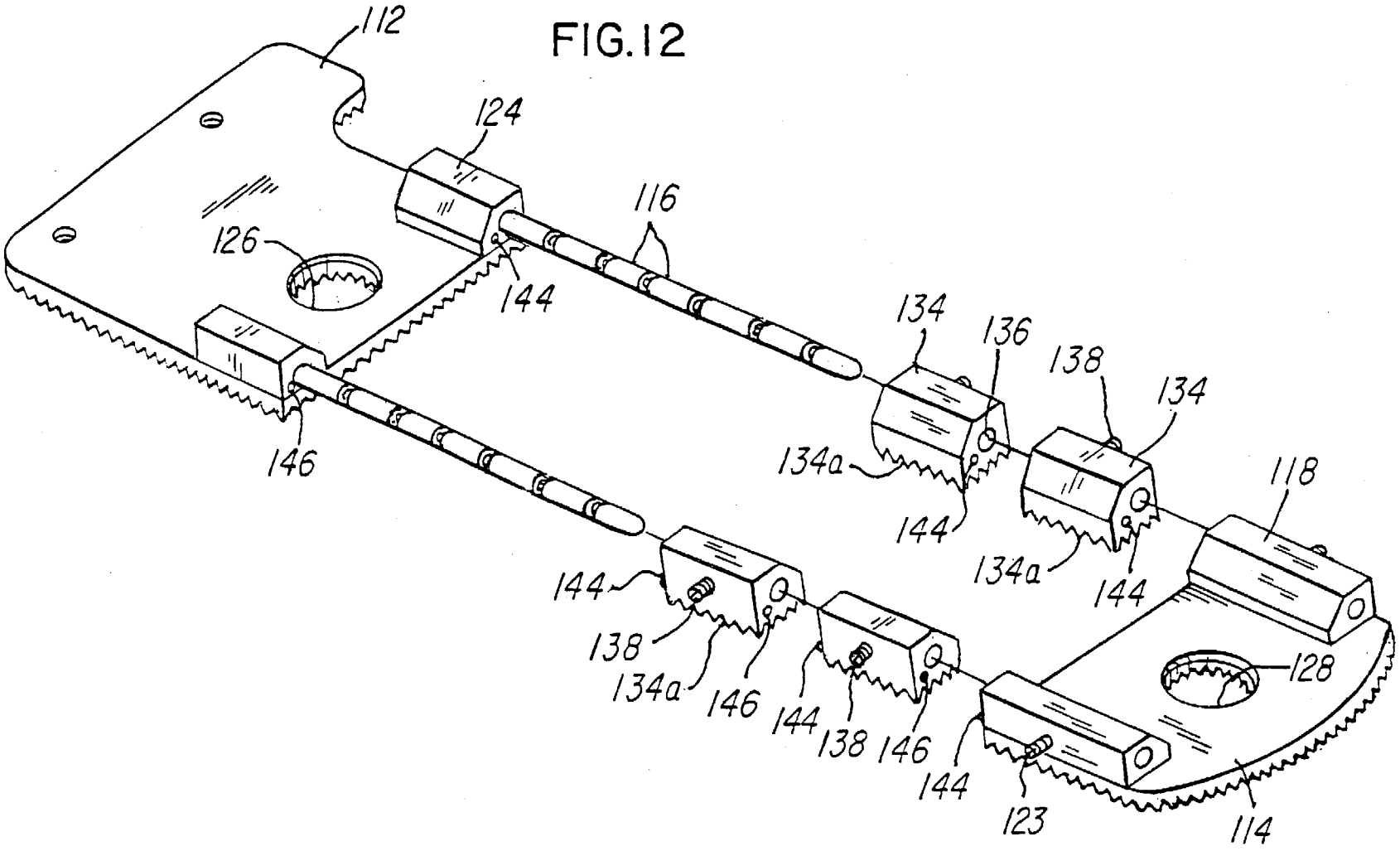
FIG. 12 is a perspective, exploded view showing a plurality of spacers which may be mounted on the pins.
Figure 13:
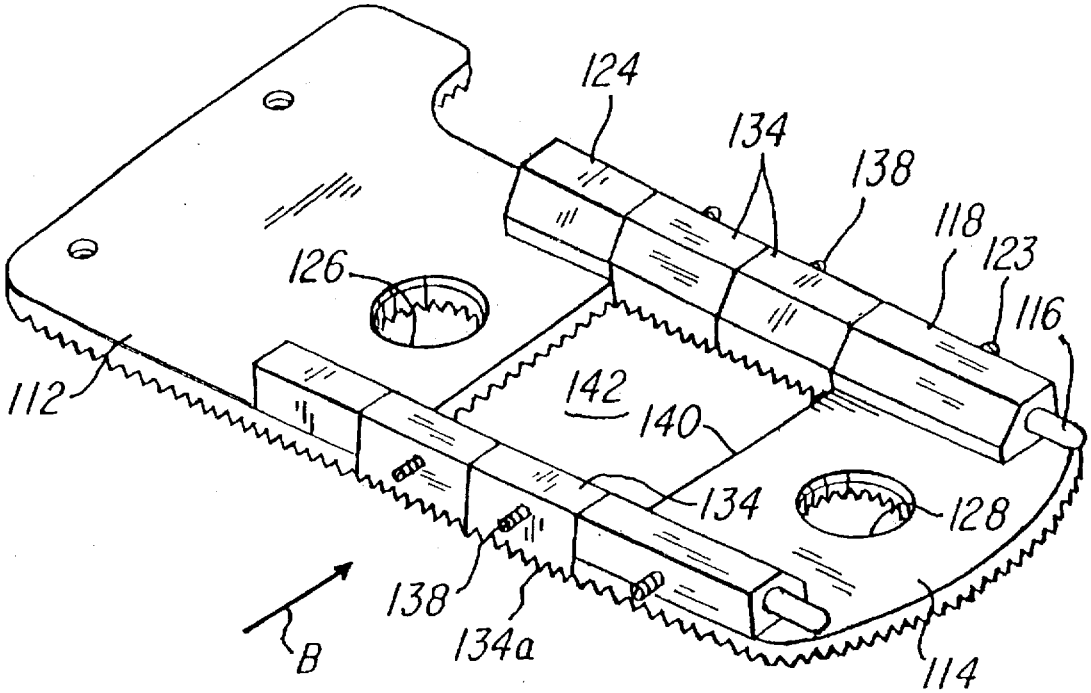
FIG. 13 is another perspective view, similar to that of FIG. 12, showing the spacer clamps and template clamp adjustably mounted on the clamp support.

FIGS. 12–16 and 18 show another embodiment wherein adjustment means 115 comprises a plurality of spacer clamps 134 for mounting on the plurality of pins 116, thereby permitting the configuration, shape and clamping area of the adjustable template clamp 110 to be adjusted. The spacer clamps 134 also provide a third template 140. As best shown in FIG. 12, each of the spacer clamps 134 has a clamping surface 134*a* which becomes coplanar with the bottom surfaces 112*a* and 114*a* of the clamp support 112 and template clamp 114, respectively. Each of the spacer clamps 134 also comprises an aperture 136 for receiving the pin 116. Each aperture 136 (FIG. 12) comprises detent means or a spring loaded detent 138 which is identical to the detent 118 described above.

As shown in FIGS. 10 and 11, the adjustable template clamp 110 is adjustable so that the first and second templates 126 and 128 are a predetermined distance (indicated by double arrow F in FIG. 10) apart. This predetermined distance may be adjusted by sliding the template clamp 114 along the pins 116. It is further to be noted that the spacer clamps 134 cooperate with the clamp support 112 and template clamp 114 to define the third template 140 (FIG. 13) having a generally rectangular sewing area 142. If it is desired to increase the clamping area of the adjustable clamp 110 and provide yet a third template 140, the spacer clamps 134 may be positioned on the plurality of pins 116, between the clamp support 112 and template clamp 114.

Figure 14:
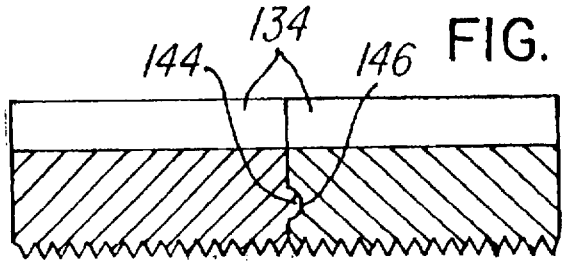
FIG. 14 is a sectional view of a pair of spacer clamps showing details of aligning knobs and receiving grooves.

In order to facilitate the proper alignment and mating of the clamp support 112, template clamp 114, and spacer clamps 134, a plurality of aligning knobs 144 are provided. As best shown in FIG. 14, the aligning knobs 144 engage and cooperate with mating receiving grooves 146 to ensure proper alignment of the clamp support 112, template clamp 114 and spacer clamps 134.

Figure 15:
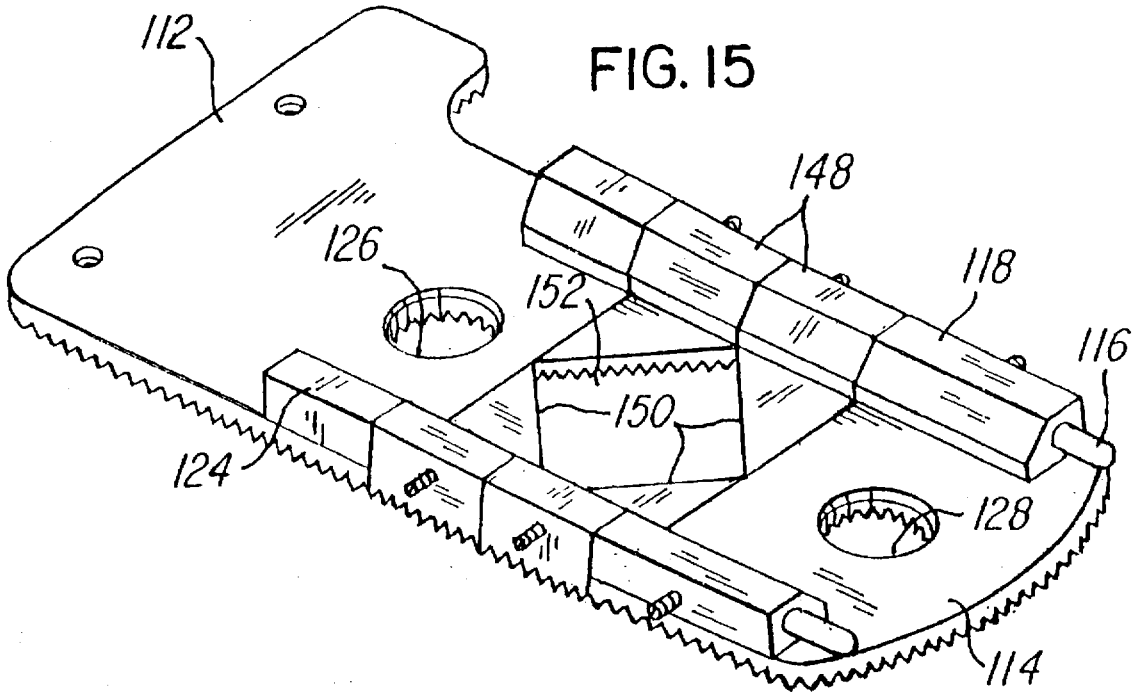
FIG. 15 is another perspective view showing another set of spacer clamps which define a diamond-shaped aperture.
Figure 16:
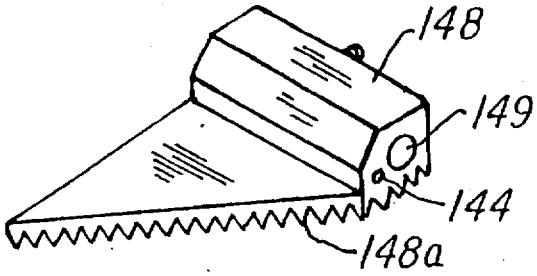
FIG. 16 is a perspective view of one of the spacer clamps shown in FIG. 15.

FIGS. 15 and 16 show still another embodiment wherein the spacer clamps 134 may be substituted with a second set of spacer clamps 148. The second set of spacer clamps 148 cooperate to provide a fourth template 150 which defines a diamond-shaped sewing area 152. Although not shown, other shapes and sizes of templates may be provided to define sewing areas by substituting different shaped spacer clamps for spacer clamps 134 and 148. It should be noted that the spacer clamp 134*a* comprises a bottom clamping surface 134*a* and spacer clamp 148 comprises bottom clamping surface 148*a*. The bottom clamping surfaces are knurled to facilitate clamping the workpiece against the cloth plate 55.

The first template 126 corresponds to a first predetermined stitch pattern and the second template 128 corresponds to a second predetermined stitch pattern. Likewise, the third and fourth templates 140 and 150 correspond to a third and fourth predetermined stitch patterns.

Figure 17:
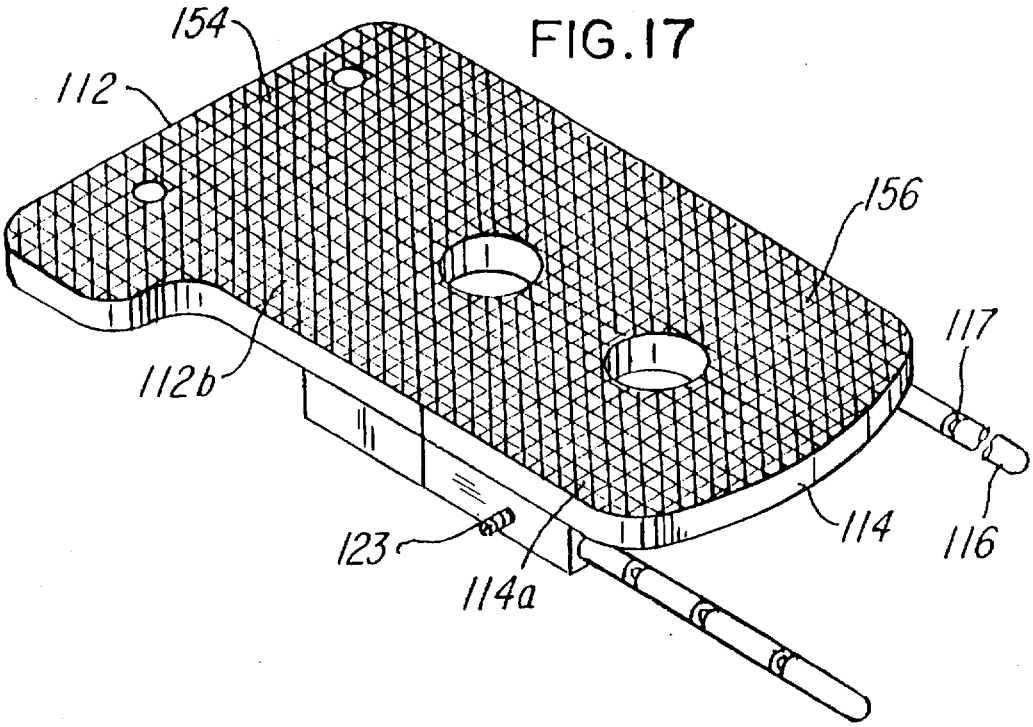
FIG. 17 is a bottom view showing the clamping areas of the clamp support and template clamp.
Figure 18:
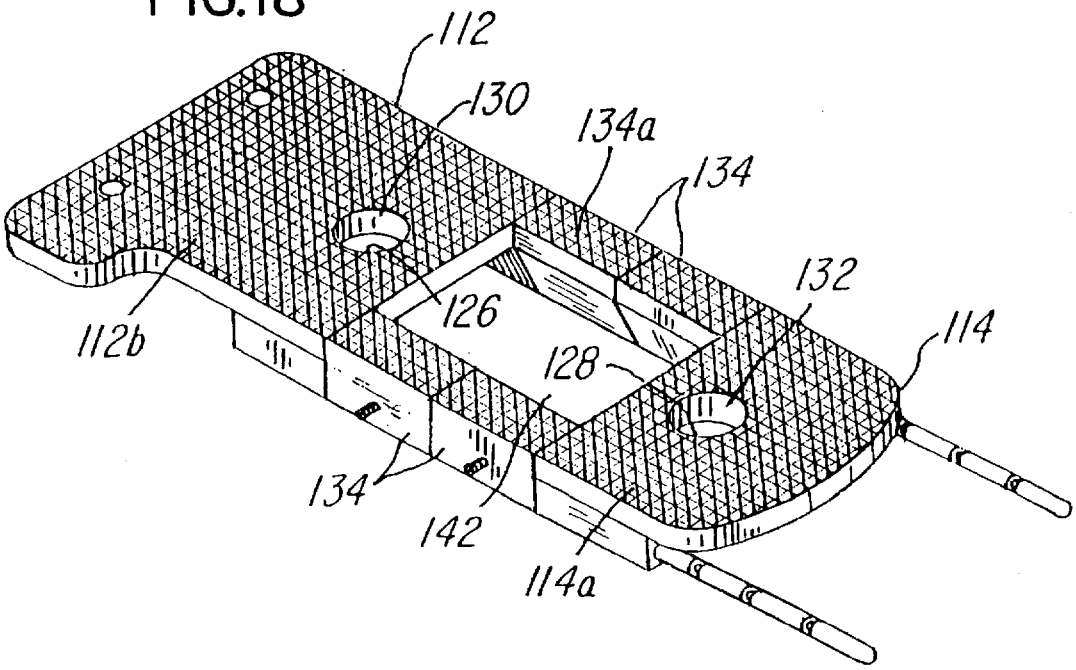
FIG. 18 is another bottom view showing details of the clamping areas of the clamp support, template clamp, and spacer clamps.

As best shown by the bottom views in FIGS. 17 and 18, the clamp support 112 defines a first clamping area 154, and the template clamp 114 defines a second clamping area 156. The first and second clamping areas 154 and 156 generally correspond to the shape of the clamp support 112 and template clamp 114. It is to be noted that when the spacer clamps 134 are adjustably mounted on the pins 116 (FIG. 18), they define a third clamping area 157 which further facilitates clamping the workpiece against the cloth plate 55 (FIG. 1). In the embodiment being described, the first, second and third clamping areas 154, 156, and 157 are contiguous.

Figure 19:
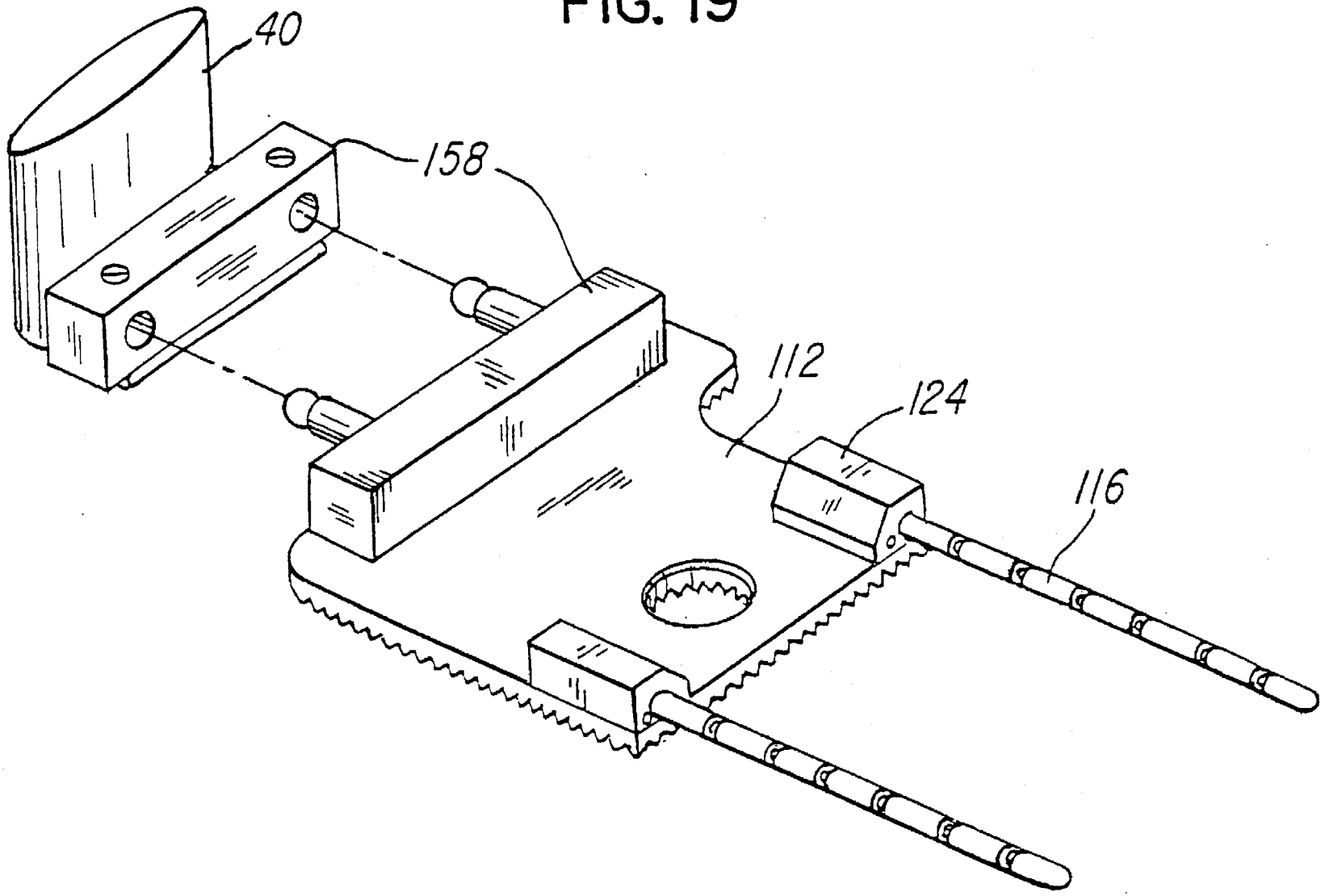
FIG. 19 is an exploded, perspective view showing how the clamp support may be mounted on the L-shaped bracket using a quick-release mechanism.
Figure 20:
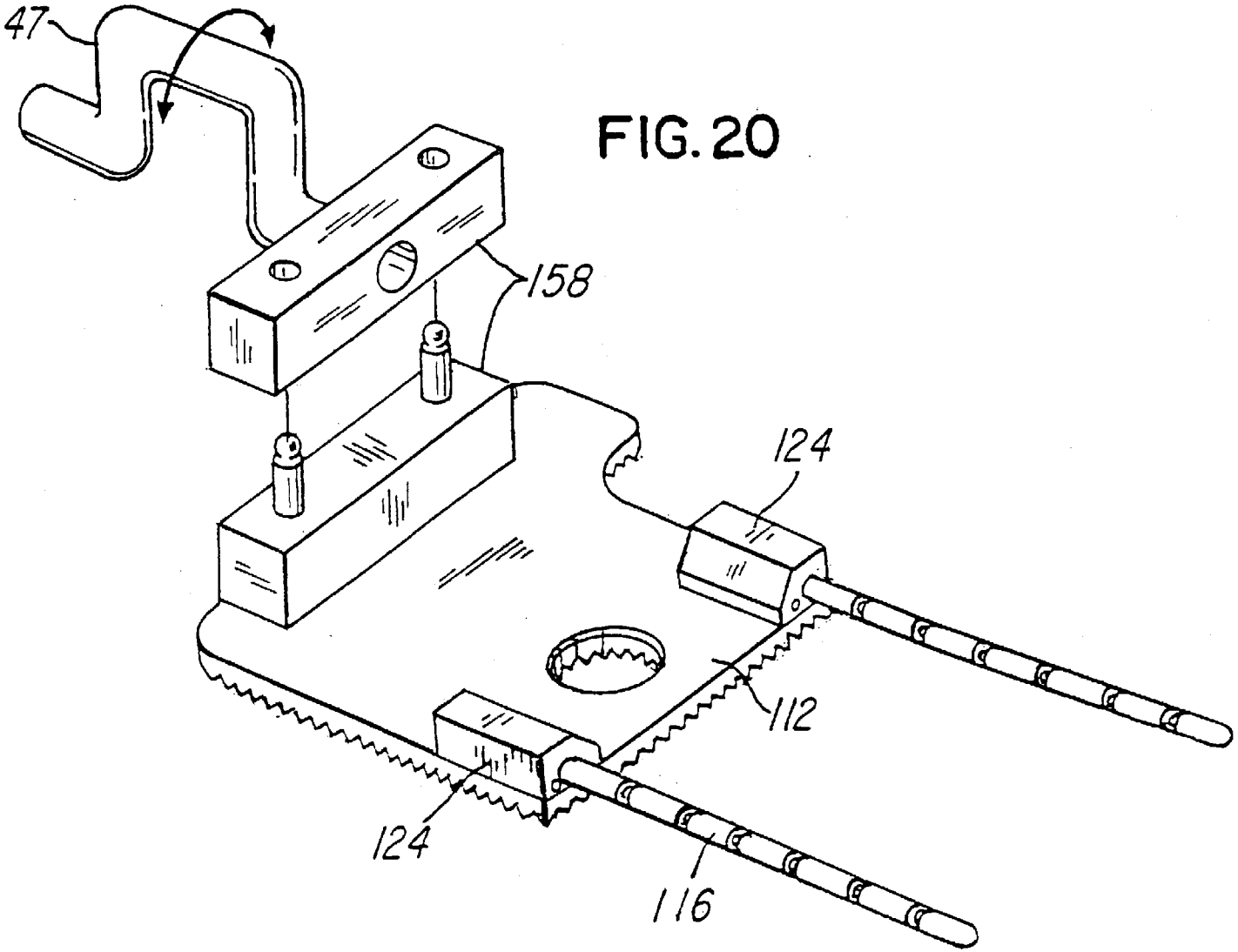
FIG. 20 is another exploded, perspective view showing the clamp support being mounted on a 360° crank using the quick-release mechanism.

The adjustable clamp 110 may be mounted directly to the L-shaped bracket 40 (FIG. 1) using connecting means or a connector 158. The connector or connecting means comprises the quick-release mechanism described above which is used to detachably mount the clamp support 112 onto the L-shaped bracket 40, as shown in FIG. 19. It should also be noted that the adjustable clamp 110 may be used as an inner clamp for clamping the inner portion of a workpiece. In this regard, the connecting means may comprise a 360° crank 47 and quick-release mechanism, as best shown in FIG. 20.

A method for clamping a workpiece at the sewing station 20 will now be described. The method comprises the steps of mounting the clamp support 112 onto the L-shaped bracket 40 of the sewing machine 10 with the connector 158. The template clamp 114 is then adjustably mounted onto the clamp support 112 in the manner described above. The adjustable clamp 110 is then adjusted by the operator so that the first and second templates 126 and 128 are positioned a predetermined distance apart. If it is desired to clamp a portion of the workpiece which lies between the clamp support 112 and template clamp 114, then the spacer clamps 134 may be adjustably mounted on the pins 116. Once the adjustable clamp 110 is assembled and mounted onto the sewing machine 10, the master controller (not shown) can energize drive means 32 to cause the adjustable clamp 110 to clamp the workpiece 12 (FIG. 2) against the second workpiece 13 or against the cloth plate 55 (FIG. 1) so that the sewing machine 10 can sew the predetermined stitch patterns using the first or second templates 126 and 128, respectively.

If the predetermined stitch pattern to be sewn on the workpiece 12 must be adjusted thereby, in turn, necessitating that the templates 126 and 128 are farther apart, for example, then the template clamp 114 would be adjustably slid on the pins 116 away from the clamp support 112. It is to be noted that, if the operator desires to provide the third template 140 or fourth template 150, then the spacer clamps 134 or 148, respectively, would be adjustably mounted on pins 116.

It should be appreciated that, although the clamp support 112 and template clamp 114 have been shown and described as comprising the first and second templates 126 and 128, respectively, they could be provided without any template if it were desired to provide an adjustable clamp 110 having clamping areas which are adjustable in size and configuration. By using either the spacer clamps 134 or 148, the operator may increase the clamping size of the adjustable clamp 110 or provide an enlarged clamping area or to provide the third or fourth templates 140 and 150.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. An adjustable clamp for use with a sewing machine adapted to sew a predetermined stitch pattern, comprising:

a clamp support;

a template clamp for adjustably and detachably mounting onto said clamp support, said template clamp comprising a template which defines the entire pattern of the predetermined stitch pattern; and wherein said adjustable clamp further comprises a plurality of spacer clamps for adjustably mounting between said clamp support and said template clamp.

2. An adjustable clamp, comprising:

a clamp support; and a template clamp for adjustably mounting onto said clamp support; and a plurality of spacer clamps for adjustably mounting between said clamp support and said template clamp;

said plurality of spacer clamps each comprising a predetermined shape, said predetermined shapes defining a predetermined template when said plurality of spacer clamps are adjustably mounted between said clamp support and said template clamp.

3. An adjustable clamp for use in a sewing machine, said adjustable clamp comprising:

a clamp support;

a clamp;

adjustable support means for adjustably supporting said clamp on said clamp support; and a plurality of spacer clamps;

said clamp support defining a first clamping area and said clamp defining a second clamping area;

said adjustable support means adjustably supporting said spacer clamps between said clamp support and said clamp; and said spacer clamps cooperating to define a third clamping area.

4. The adjustable clamp as recited in claim 3 wherein said first, second and third clamping areas are contiguous.

5. An adjustable clamp for pressing a workpiece against a sewing surface, with the adjustable clamp being usable with a sewing machine adapted to sew a predetermined stitch pattern, said adjustable clamp comprising;

a clamp support;

a template clamp, said template clamp comprising a template which defines the entire pattern of the predetermined stitch pattern;

adjustable support means for adjustably supporting said template clamp on said clamp support;

said clamp support defining a first clamping area and said template clamp defining a second clamping area;

said adjustable support means adjustably supporting said template clamp on said clamp support such that (1) said clamp support and said template clamp are separated by a first distance when they are positioned at a first location, and (2) said clamp support and said template clamp are separated by a second distance when they are positioned at a second location; and said adjustable clamp being adapted for compressing at least a portion of the workpiece between said adjustable clamp and the sewing surface.

6. The adjustable clamp as recited in claim 5 wherein said template comprises a first cut-out area.

7. The adjustable clamp as recited in claim 6 wherein said clamp support comprises a second cut-out area, said adjustable support means adjustably supporting said template clamp such that the distance between said first cut-out area and said second cut-out area may be adjusted.

8. An adjustable clamp for use in a sewing machine adapted to sew a predetermined stitch pattern, said adjustable clamp comprising:

a clamp support;

a template clamp, said template clamp comprising a template which defines the entire pattern of the predetermined stitch pattern; and adjustable support means for adjustably supporting said template clamp on said clamp support;

said adjustable support means comprising at least one pin;

said adjustable support means further comprising detent means located on said template clamp for cooperating with said at least one pin to adjustably secure the template clamp to the clamp support; and said detent means further comprising a spring loaded detent.

9. A method for clamping a workpiece against a sewing surface, with the clamp being usable in a sewing machine adapted to sew a predetermined stitch pattern, comprising the steps of:

mounting a support clamp onto said sewing machine with a connector;

adjustably mounting a template clamp onto the support clamp such that said template clamp and said support clamp are located a predetermined distance apart, said template clamp comprising a template which defines the entire pattern of the predetermined stitch pattern;

positioning the workpiece on said sewing surface; and forcing said template clamp and support clamp against said workpiece to compress at least a portion of said workpiece between said sewing surface and at least one of said template clamp and support clamp;

said support clamp comprises a plurality of pins which are generally parallel, said template clamp comprising a plurality of detents for receiving said plurality of pins, said method further comprising the step of:

mounting said detents on said plurality of pins such that said template clamp can be adjustably mounted on said pins so that said clamp and said template clamp are located a predetermined distance apart;

wherein said method further comprises the step of:

mounting a plurality of spacer clamps onto said pins between said template clamp and said clamp.

10. An adjustable clamp for use with a sewing machine adapted to sew a predetermined stitch pattern, comprising:

a clamp support; and a template clamp, said template clamp comprising a plurality of clamp members coupled together to define the entire pattern of the predetermined stitch pattern;

further comprising a secondary clamp, wherein:

said clamp support comprises a plurality of pins extending therefrom, and said secondary clamp comprising a plurality of detents which receive said plurality of pins.

11. The adjustable clamp as recited in claim 10 wherein said plurality of clamp members are mounted on said plurality of pins.

12. A sewing machine for sewing a plurality of predetermined stitch patterns on a workpiece, said sewing machine comprising:

a controller for controlling the operation of the sewing machine;

an adjustable clamp for forcing the workpiece against a clamping surface in the sewing machine;

a connector for detachably coupling said adjustable clamp to the sewing machine; and drive means coupled to said controller and said connector for driving said adjustable clamp into engagement with the workpiece to secure the workpiece against the clamping surface, said drive means also being capable of moving the clamped workpiece in accordance with a computer program in order to sew at least one of the predetermined stitch patterns on the workpiece;

said adjustable clamp comprising:

a clamp support;

a clamp;

a plurality of spacer clamps; and adjustable support means for adjustably supporting said clamp on said clamp support and for adjustably supporting said spacer clamps between said clamp support and said clamp;

said plurality of predetermined stitch patterns comprising a first predetermined stitch pattern and a second predetermined stitch pattern;

said clamp support defining a first clamping area for clamping the workpiece such that said first predetermined stitch pattern may be sewn on the workpiece;

said clamp defining a second clamping area for clamping the workpiece such that said second predetermined stitch pattern may be sewn; and said spacer clamps cooperating to define a third clamping area.

13. The sewing machine as recited in claim 12 wherein said first, second and third clamping areas are contiguous.

14. A sewing machine for sewing a plurality of predetermined stitch patterns on a workpiece, said sewing machine comprising:

a controller for controlling the operation of the sewing machine;

an adjustable clamp for forcing the workpiece against a clamping surface in the sewing machine;

a connector for detachably coupling said adjustable clamp to the sewing machine; and drive means coupled to said controller and said connector for driving said adjustable clamp into engagement with the workpiece to secure the workpiece against the clamping surface, said drive means also being capable of moving the clamped workpiece in accordance with a computer program in order to sew at least one of the predetermined stitch patterns on the workpiece;

said adjustable clamp comprising:

a clamp support;

a template clamp, said template clamp comprising a template which defines one entire pattern of the plurality of predetermined stitch patterns; and adjustable support means for adjustably and detachably supporting said template clamp on said clamp support;

including structure defining the clamping surface, wherein:

said clamp support defines a first clamping area and said clamp defines a second clamping area;

said adjustable support means adjustably supports said template clamp on said clamp support such that the distance between said template clamp and said clamp support may be adjusted; and said drive means is adapted to drive said adjustable clamp toward the clamping surface to force the workpiece against the clamping surface.

15. A sewing machine for sewing a plurality of predetermined stitch patterns on a workpiece, said sewing machine comprising:

a controller for controlling the operation of the sewing machine;

an adjustable clamp for forcing the workpiece against a clamping surface in the sewing machine;

a connector for detachably coupling said adjustable clamp to the sewing machine; and drive means coupled to said controller and said connector for driving said adjustable clamp into engagement with the workpiece to secure the workpiece against the clamping surface, said drive means also being capable of moving the clamped workpiece in accordance with a computer program in order to sew at least one of the predetermined stitch patterns on the workpiece;

said adjustable clamp comprising:

a clamp support;

a template clamp, said template clamp comprising a template which defines one entire pattern of the plurality of predetermined stitch patterns;

adjustable support means for adjustably and detachably supporting said template clamp on said clamp support;

wherein one of said template clamp and said clamp support comprises a first cut-out area, and wherein said template clamp comprises said first cut-out area and said clamp support comprises a second cut-out area, said adjustable support means adjustably supporting said template clamp to said clamp support such that the distance between said first cut-out area and said second cut-out area may be adjusted.

16. A sewing machine for sewing a plurality of predetermined stitch patterns on a workpiece, said sewing machine comprising:

means defining a clamping surface;

a controller for controlling the operation of the sewing machine;

an adjustable clamp for forcing the workpiece against a clamping surface in the sewing machine;

a connector for detachably coupling said adjustable clamp to the sewing machine; and drive means coupled to said controller and said connector for driving said adjustable clamp into engagement with the workpiece to secure the workpiece against the clamping surface, said drive means also being capable of moving the clamped workpiece in accordance with a computer program in order to sew at least one of the predetermined stitch patterns on the workpiece;

said adjustable clamp comprising;

a clamp support;

a template clamp, said template clamp comprising a template which defines one entire pattern of the plurality of predetermined stitch patterns;

adjustable support means for adjustably supporting said template clamp on said clamp support;

said adjustable support means comprising at least one pin;

said adjustable support means further comprising detent means located on said template clamp for cooperating with said pin to adjustably secure the template clamp to the clamp support; and said detent means further comprising a spring loaded detent.

17. A sewing machine for sewing a plurality of predetermined stitch patterns on a workpiece, said sewing machine comprising:

a controller for controlling the operation of the sewing machine;

an adjustable clamp for forcing the workpiece against a clamping surface in the sewing machine;

a connector for detachably coupling said adjustable clamp to the sewing machine; and drive means coupled to said controller and said connector for driving said adjustable clamp into engagement with the workpiece to secure the workpiece against the clamping surface, said drive means also being capable of moving the clamped workpiece in accordance with a computer program in order to sew at least one of the predetermined stitch patterns on the workpiece;

said adjustable clamp comprising:

a clamp support;

a template clamp, said template clamp comprising a template which defines one entire pattern of the plurality of predetermined stitch patterns; and adjustable support means for adjustably and detachably supporting said template clamp on said clamp support; and wherein said adjustable support means comprises a plurality of spacer clamps.

18. The sewing machine as recited in claim 17 wherein said plurality of spacer clamps each comprise a predetermined shape which cooperate to define a template when said plurality of spacer clamps are adjustably mounted between said clamp support and said template clamp.

19. An adjustable clamp for use in a sewing machine adapted to sew a predetermined stitch pattern, said adjustable clamp comprising:

a clamp support;

a template clamp, said template clamp comprising a template which defines the entire pattern of the predetermined stitch pattern; and adjustable support means for adjustably and detachably supporting said template clamp on said clamp support; and wherein said adjacent support means comprises a plurality of spacer clamps.

20. The adjustable clamp as recited in claim 19 wherein said plurality of spacer clamps each comprise a predetermined shape which cooperate to define a template when said plurality of spacer clamps are adjustably mounted between said clamp support and said template clamp.

21. An adjustable clamp for use with a sewing machine adapted to sew a predetermined stitch pattern, comprising:

a clamp support; and a template clamp for adjustably and detachably mounting onto said clamp support, said template clamp comprising a template which defines the entire pattern of the predetermined stitch pattern; and said clamp support and template clamp each define a clamping area for contact with the workpiece; and said clamp support includes a connector adapted for mounting the adjustable clamp on a driver of the sewing machine for movement toward a workpiece positioned on a sewing surface to compress the workpiece between said clamping areas and the sewing surface.

22. An adjustable clamp for use with a sewing machine adapted to sew a predetermined stitch pattern, comprising:

a clamp support; and a template clamp, said template clamp comprising a plurality of clamp members coupled together to define the entire pattern of the predetermined stitch pattern;

said clamp support and template clamp each define a clamping area for contact with the workpiece; and said adjustable clamp is adapted for applying a predetermined amount of pressure against a workpiece positioned on a sewing surface.

23. An adjustable clamp useful with a sewing machine adapted to sew a predetermined stitch pattern, said adjustable clamp comprising:

at least one pin; and a template clamp defining a surface for engaging a workpiece, said template clamp having at least one detent adapted to slidably receive said at least one pin for adjustably supporting said template clamp, said template clamp comprising a template which defines the entire pattern of the predetermined stitch pattern.

24. The adjustable clamp as recited in claim 23 wherein said at least one detent comprises a sleeve adapted to receive said at least one pin for adjustably supporting said template.

25. The adjustable clamp as recited in claim 23 wherein said detent includes means for adjustably retaining said at least one pin in said at least one sleeve.

26. The adjustable clamp as recited in claim 25 wherein said means for adjustable retaining said at least one pin includes a spring-loaded ball.

27. The adjustable clamp as recited in claim 23 further comprising:

a clamp support including said at least one pin, said clamp support having structure cooperating with said template clamp to define said surface for engaging the workpiece.

28. The adjustable clamp as recited in claim 26 wherein the clamp support includes a connector for engagement with the sewing machine.

29. The adjustable clamp as recited in claim 23 wherein said adjustable clamp comprises at least two pins and said template clamp comprises at least two detents.

30. The adjustable clamp as recited in claim 23 wherein said template clamp defines a template for exposing the workpiece to a sewing needle of the sewing machine.

31. The adjustable clamp as recited in claim 23 wherein said at least one pin is generally parallel to said surface for engaging the workpiece.

32. A clamp support for use with sewing machine adapted to sew a predetermined stitch pattern, comprising:

structure defining a surface for engaging a workpiece; and at least one pin associated with the clamp support for slidable receipt in a sleeve of a template member, said template member comprising a template which defines the entire pattern of the predetermined stitch pattern.

33. The clamp support as recited in claim 32, wherein said clamp support defines a cut-out area for exposing the workpiece to a sewing needle of the sewing machine.

34. The clamp support as recited in claim 32 including a connector for engagement with the sewing machine.

35. The clamp support as recited in claim 32 wherein said at least one pin is generally parallel to said surface for engaging the workpiece.

* * * * *